United States Patent [19]

Locke

[11] 4,171,703

[45] Oct. 23, 1979

[54] MULTIPLE BOWL ARRANGEMENT FOR WATER PIPE OR BONG

[75] Inventor: Frank B. Locke, Gaithersburg, Md.

[73] Assignee: Progressive Plastics, Inc., Rockville, Md.

[21] Appl. No.: 792,263

[22] Filed: Apr. 29, 1977

[51] Int. Cl.[2] ..... A24F 5/00

[52] U.S. Cl. ..... 131/173; 131/180; 131/222; 131/226

[58] Field of Search ..... 131/171 R, 179, 180, 131/173, 174, 196, 176, 186, 214, 216, 10.3, 220, 198 R, 221, 198 A, 222, 224, 226, 225; D27/3

[56] References Cited

U.S. PATENT DOCUMENTS

| | | | |
|---|---|---|---|
| 682,278 | 9/1901 | Roller | 131/180 |
| 972,737 | 10/1910 | Tobias | 131/198 R |
| 1,302,047 | 4/1919 | Hurst | 131/180 |
| 2,153,955 | 4/1939 | Choquette | 131/176 |
| 3,428,050 | 2/1969 | Kandel | 131/10.3 |
| 3,881,499 | 5/1975 | McFadden et al. | 131/173 |

*Primary Examiner*—Robert W. Michell
*Assistant Examiner*—V. Millin
*Attorney, Agent, or Firm*—Strauch, Nolan, Neale, Nies & Kurz

[57] ABSTRACT

A multiple bowl arrangement for a water pipe, bong or other smoking device in the form of a mounting base in place of the conventional bowl and a turret or magazine with multiple bowls rotatably mounted on the base so that each bowl is brought into successive, selective registry with the primary smoke inlet passageway of the smoking device. Visual indicators may be provided on the base and the turret to assure registry of any one bowl in use with the primary smoke inlet passageway of the smoking device.

8 Claims, 5 Drawing Figures

MULTIPLE BOWL ARRANGEMENT FOR WATER PIPE OR BONG

BACKGROUND OF THE INVENTION

The invention relates to devices for smoking or burning, organic substances and more particularly to a water pipe, bong or similar structure having a plurality of bowls for containing the smoking substance, each bowl being brought into successive, selective registry with the primary smoke inlet passageway of the pipe, whereby several bowls may be prepared for smoking and enjoyed in serial fashion, without the nuisance of cleaning and refilling a bowl for each successive smoke, as is the case with conventional, prior art structures. The multiple bowl arrangement may be constructed as an attachment to fit on the bowl stem of any one of a number of water pipes or bongs.

The concept of a smoking pipe having a number of bowls as an integral assembly, the bowls being smoked in serial fashion, is disclosed in U.S. Pat. No. 1,302,047 issued to C. Hurst. The pipe structure further requires a spring to assure smoke tight registry of aligned openings between any one bowl and the stem as well as a pair of packing members to further assure a good seal between these aligned openings. A pipe with a pair of oppositely directed bowls selectively, serially filled and smoked is disclosed in prior U.S. Pat. Nos. 612,837 issued to L. Enlenstein and 1,578,810 issued to B. L. Dall. The U.S. Pat. to W. C. Rogers, No. 1,213,021 is representative of a pipe having a single bowl fed from an integral storage magazine of tobacco. An interesting device for lighting and smoking up to 20 cigarettes in serial fashion is disclosed in U.S. Pat. No. 1,864,400, issued to D. Berger.

In the particular art of water pipes or bongs, where more exotic organic substances are smoked for pleasure, two sizes of substance bowls are usually marketed with the bong. The first is a small, "one hit" bowl which will hold enough smoking substance to provide but one or possibly two, full inhalations of burning substance. Thereafter, the bowl is refilled with a substance for further use. The second sized bowl is substantially larger and is known as a "party bowl." This bowl is filled once and then lit and used in succession by several smokers. A principal advantage of the party bowl is that it needs to be filled but once to be used by several smokers. However, an objectional feature is that the bong must be passed quickly from one smoker to the next before the ignited substance is extinguished because of the absence of drawing a quantity of air through it. Furthermore, the water or cooling fluid in the bong becomes contaminated rather quickly as ashes and other burnt particles are drawn into the water during use of the bong.

An improved bowl arrangement for a water pipe is disclosed in U.S. Pat. No. 3,863,646 issued to R. W. Kahler, wherein a one-piece reversible bowl assembly is provided, having a "one hit" bowl on one side and a "party bowl" on the other.

A significant advance in the art of water pipes or bongs is disclosed in U.S. Pat. No. 3,881,499 issued to M. D. McFadden et al. The water pipe includes an ash and contaminant trap disposed beneath an inhalation and water chamber so that the water or other cooling fluid remains clear and uncontaminated even after a number of uses of the bong. This bong has particular significance in conjunction with the multiple bowl arrangement as disclosed herein, as a water pipe or bong is provided that includes multiple smoking substance bowls that may be used in serial fashion with the same water or cooling fluid supply which remains clear and uncontaminated even after prolonged use.

SUMMARY OF THE INVENTION

It is an object of the invention to provide an attachment in the form of a multiple bowl assembly for a water pipe, bong or other smoking device including a base which substitutes for the bowl of the smoking device, and a rotatable turret on the base having a plurality of bowls mounted thereon, each of which may be brought into selective communication with the smoke conduit of the smoking device.

It is another object of the invention to provide a multiple bowl assembly attachment for a smoking device which may be used with any one of a wide variety of bongs, water pipes or other smoking pipes or devices.

It is a further object of the invention to provide a multiple bowl assembly attachment for a smoking device having a base component mounted on the smoking device and an easily removed, and replaced multiple bowl member which may be cleaned while removed.

It is yet a further object of the invention to provide a multiple bowl assembly attachment for a smoking device including a base and a multiple bowl turret or the base and including easily, visually perceived, cooperating indicia on the base and turret for assuring proper alignment of a selected bowl for smoking.

Yet a further object of the invention is to provide a water pipe or bong having an ash and solid matter contaminant trap disposed between an inhalation and fluid coolant chamber of the pipe and the primary smoke conduit thereof, in combination with a multiple bowl assembly mounted on the smoke conduit whereby a plurality of successive smoking experiences may be enjoyed without deleterious contamination of the coolant being used.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which.

DESCRIPTION OF THE PREFERRED EMBODIMENT

Figure 1:
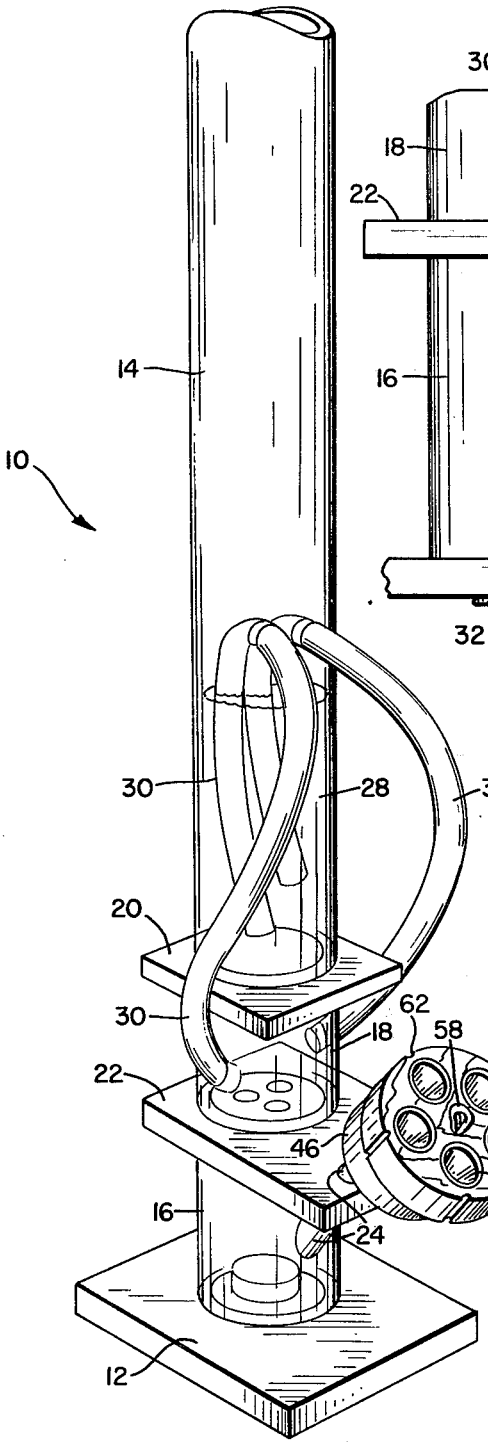
FIG. 1 is a perspective view of a water pipe or bong with a multiple bowl assembly.
Figure 2:
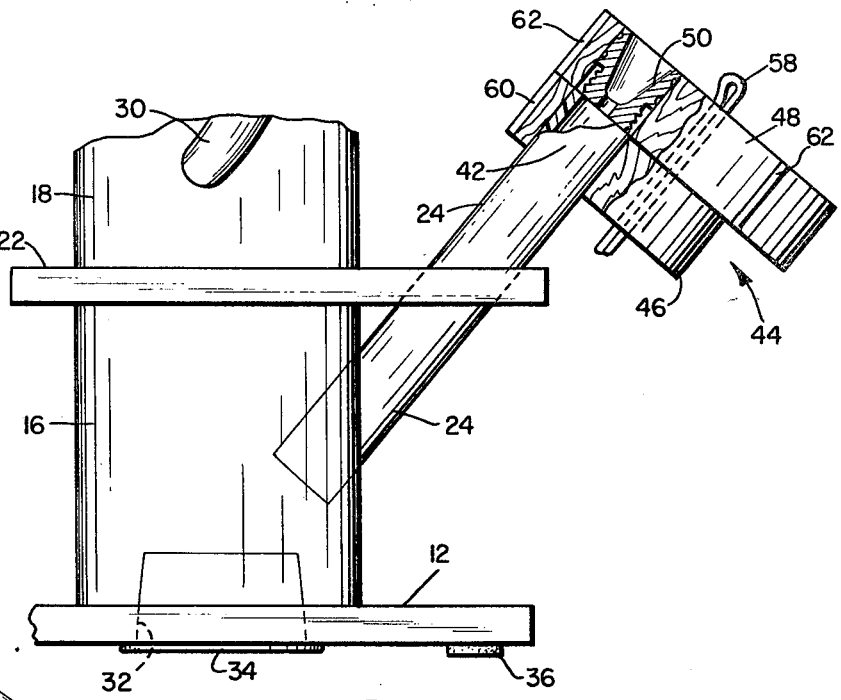
FIG. 2 is an enlarged scale, partial elevation view of the bong and multiple bowl assembly as shown in FIG. 1, the bowl assembly components being shown partly in section.

A water pipe or bong 10 is illustrated in FIG. 1 and is similar in structure and function to that disclosed and claimed in prior U.S. Pat. No. 3,881,499 issued to McFadden, et al. Bong 10 is supported in generally vertically upright fashion by a base 12 and is divided into an upper, inhalation and water chamber 14, a lower ash and contaminant trap 16 and an intermediate smoke chamber 18. Chambers 14 and 18 are divided by a solid plate 20 while chambers 16 and 18 are divided by a perforated spacer plate 22. A primary or first smoke conduit 24 is mounted through a forward, projecting edge 26 of spacer plate 22 and extends within trap 16. Smoke passes upwardly through plate 22 to chamber 18 and to chamber 14 and a supply of coolant 28 therein through secondary conduiting or tubes 30,30. Coolant 28 may be water, wine or any other suitable fluid. As illustrated in FIG. 2, base 12 may be provided with an opening 32 closed by a friction fitted plug 34 for periodic removal and cleaning of trap 16, and supporting cork pads or feet 36 at each corner of base 12.

Figure 3:
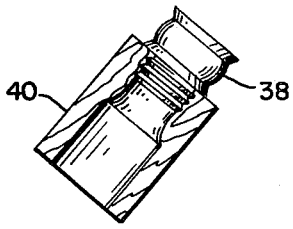
FIG. 3 is a section view of a conventional water pipe bowl structure.

A conventional brass or aluminum smoking substance bowl 38 (FIG. 3) is threaded or friction fit within an open, cylindrical base 40 which is, in turn, friction fitted onto the upper, open end 42 of smoke conduit 24 (FIG. 2) when the single bowl 38 is to be used.

Figure 4:
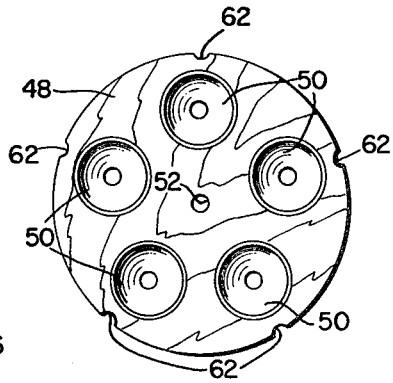
FIG. 4 is a top, plan view of the turret member and bowls of the multiple bowl assembly.

Bowl 38 and its base 40 may be replaced by the multiple bowl assembly 44 when several, successive uses of the pipe are desired. Assembly 44 includes a base 46, a turret 48 and a plurality of bowls 50, equally radially and circumferentially spaced about a center bore 52 (FIG. 4) through turret 48.

Figure 5:
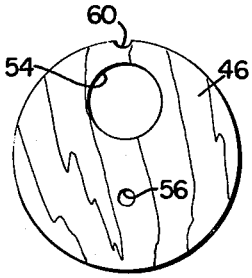
FIG. 5 is a top plan view of the base component of the multiple bowl assembly.

Base 46 has a cylindrical through opening 54 (FIG. 5) which conforms generally to the outer diameter of end 42 of first smoke conduit 24 so as to be readily secured thereon, yet removable therefrom when desired. A second, small diameter bore 56 is formed therethrough for reception of a pin 58 which is inserted through both bores 52 and 56 to hold the assembly 44 together. The components are easily separated for cleaning bowls 50 in turret 48 by merely lifting turret 48 and pin 58 off of base 46.

It should be noted there that the radial spacing of the centerline of each bowl 50 from bore 52 is the same as the spacing of bores 54 and 56 of base 46, so that upon rotation of turret 48, each bowl 50 may be brought into selective, successive registry with first smoke conduit 24, as illustrated in FIG. 2.

Registry of any one bowl 50 with conduit 24 is assured by provision of a single indicia line 60 formed on base 46 which is aligned with any one of a number of similar indicia lines 62 formed in turret 48, one being provided for each bowl 50.

In the preferred embodiment illustrated and described, the major components of bong 10 are made from Plexiglas, a trademark for an acrylic resin or plastic, more particularly a glasslike thermoplastic made by polymerizing acrylic or methacrylic acid or a derivative of either, especially an ester (as methyl methacrylate). Bowls 38 and 50 are made of aluminum, or perhaps brass, while base 40 and the base 46 and turret 48 of multiple bowl assembly 44 are made of wood or a similar inexpensive, poor heat conductive material.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In combination with a pipe for smoking tobaccos or other organic substances, the pipe including tube means interconnecting a bowl and an inhalation means, a multiple bowl assembly comprising: a supporting base including means enabling detachable mounting of said base on the tube means as a substitute for the pipe bowl; a turret rotatably mounted on said base; a plurality of smoking substance bowls on said turret, each of said plurality of bowls being arranged for selective, direct, aligned communication by contact with the pipe tube means upon rotation of said turret; and means for detachably rotatably interconnecting said turret and said base.

2. The multiple bowl assembly as claimed in claim 1 wherein said base and said turret further comprise cooperating registry means for assuring alignment of said each bowl with the pipe tube means as said each bowl is brought into selective communication with the pipe tube means.

3. The multiple bowl assembly as claimed in claim 2 wherein said cooperating registry means comprise visually perceived indicia.

4. A water pipe or bong comprising: an inhalation and fluid coolant chamber; first smoke conduit means; ash and solid matter contaminant trap means communicating with one end of said first smoke conduit means; second smoke conduit means communicating with said trap means and said inhalation and coolant chamber; a base detachably mounted upon and surrounding an end of said first smoke conduit means opposite said one end; a turret rotatably mounted on said base, and a plurality of smoking substance bowls on said turret, each of said bowls being arranged for selective registry and contact with said end of said first smoke conduit means opposite said one end upon rotation of said turret, and means for detachably, rotatably interconnecting said turret and said base.

5. The water pipe or bong as claimed in claim 4 wherein said means for detachably mounting said base on said first smoke conduit means comprise means defining a cylindrical, through opening in said base, friction fit onto said first smoke conduit means.

6. The water pipe or bong as claimed in claim 4 wherein said base and turret further comprise cooperating registry means for assuring alignment of said each bowl with said first smoke conduit means as said each bowl is brought into selective registry therewith.

7. The water pipe or bong as claimed in claim 6 wherein said cooperating registry means comprise visually perceived indicia.

8. In combination with a pipe for smoking tobaccos or other organic substances, the pipe including tube means interconnecting a bowl and an inhalation means, a multiple bowl assembly comprising: a supporting base including means enabling detachable mounting of said base on the tube means as a substitute for the pipe bowl, said base detachable mounting means also comprising a direct fluid passageway; a turret rotatably mounted on said base; a plurality of smoking substance bowls on said turret, each of said plurality of bowls being arranged for selective, direct, coaxial communication through said base fluid passageway to the pipe tube means upon rotation of said turret; and means for detachably rotatably interconnecting said turret and said base.

* * * * *